United States Patent [19]

Wood et al.

[11] Patent Number: 4,764,028

[45] Date of Patent: Aug. 16, 1988

[54] HANG BAGS HAVING HANGER PORTION OF REINFORCING MEMBER OF NON-SHRINK FILM LAMINATED BETWEEN TWO LAYERS OF SHRINK FILM

[75] Inventors: John C. Wood, Milton; Krzystjan P. Sladowski, Mississauga, both of Canada

[73] Assignee: W. R. Grace & Co., Duncan, S.C.

[21] Appl. No.: 946,339

[22] Filed: Dec. 24, 1986

Related U.S. Application Data

[63] Continuation-in-part of Ser. No. 734,375, May 15, 1985, abandoned.

[51] Int. Cl.[4] ..... B65D 33/14

[52] U.S. Cl. ..... 383/20; 206/45.34; 206/497; 206/806; 383/12; 383/21; 383/22; 493/254

[58] Field of Search ..... 383/21, 25, 22, 24, 383/30, 9, 12, 17, 31, 94, 20; 229/DIG. 12; 206/806, 45.34, 497; 493/293, 254, 260; 428/516; 156/272.6

[56] References Cited

U.S. PATENT DOCUMENTS

| | | | |
|---|---|---|---|
| Re. 26,075 | 9/1966 | Canno | 206/806 X |
| 3,228,583 | 1/1966 | Dougherty | 383/9 |
| 3,823,061 | 7/1974 | Frayer et al. | 428/516 |
| 3,881,601 | 5/1975 | Walus et al. | 206/497 |

FOREIGN PATENT DOCUMENTS

| | | | |
|---|---|---|---|
| 2535292 | 2/1977 | Fed. Rep. of Germany | 206/497 |
| 2752489 | 5/1979 | Fed. Rep. of Germany | 206/806 X |

*Primary Examiner*—Stephen Marcus
*Assistant Examiner*—Bryon Gehman
*Attorney, Agent, or Firm*—John J. Toney; William D. Lee, Jr.; Jennifer L. Skord

[57] ABSTRACT

A hang bag comprises a body portion 1 and a hanger portion 2. The body portion 1 is formed of face and rear panels 3 and 4 of shrinkable film sealingly joined together at the end 6, for instance by folding. It may be a double-side weld bag. The hanger portion 2 comprises (a) face and rear layers 10 and 11 of heat shrinkable film laminated or otherwise securely extending from, respectively, the face and rear panels 3 and 4 and (b) non-shrink film reinforcing material laminated between the layers 10 and 11, and the hanger portion (2) is provided, or capable of being provided, with a perforation 13 by which the bag may be hung from a peg. Generally all laminated surfaces are corona treated in order to improve lamination.

17 Claims, 4 Drawing Sheets

HANG BAGS HAVING HANGER PORTION OF REINFORCING MEMBER OF NON-SHRINK FILM LAMINATED BETWEEN TWO LAYERS OF SHRINK FILM

This application is a continuation-in-part of copending U.S. Ser. No. 734,375, filed May 15, 1985, now abandoned.

FIELD OF THE INVENTION

This invention relates to the construction and production of a hang bag, that is to say a bag formed of thermoplastic material in which goods may be packaged and provided with a hanger by which the bag may be hung from a peg in order to display the goods. In particular the invention relates to a hang bag formed of shrinkable film and provided with an improved hanger construction.

BACKGROUND OF THE INVENTION

Food and other goods are frequently packaged for retail purposes in shrinkable film that is then shrunk around the goods. The film may initially be in the form of a bag in which event this is open at one end to permit the insertion of the goods and is then heat sealed and shrunk around the goods. Often, such bags are decorated in a conventional manner, such as by trap printing. It is often desirable to be able to hang the bag containing the goods from a peg, for instance a hook or the peg of a peg board, for display in a supermarket. It is therefore necessary to provide hanger means by which the bag can be hung from a hook. The hanger means can be an external hanger into which the bag fits, for instance a cone-shaped cut out of paper or other material. Preferably, however, the bag includes hanger means as part of the bag.

In one system a strap or hook is permanently secured to the bag. For instance in U.S. Pat. No. 3,207,300, a strap is heat sealed to a bag. Unfortunately, it is difficult to obtain an adequately reliable seal between many externally applied straps and bags. Also it is not easy to construct the strap so that it can be sealed to the bag and will readily stand away from the bag, to permit easy hanging on a peg, during use.

In German GBM No. 8224353.0 this problem is overcome by forming the strap of non-shrinkable material so that when the bag is shrunk around the goods the strap stands clear of the bag. However, it is still necessary to take particular precautions if an adequate seal is to be achieved between the strap and the bag.

In another system the hanger means comprises a hole punched in the bag material at one end of the bag. Unfortunately, the bag material is liable to tear around the hole. Localized tearing can be minimized by providing a metal or plastic eyelet as reinforcement around the hole but it is inconvenient to secure this reinforcement and the sheet material between the reinforcement and the filled part of the bag is still liable to tear.

In Japanese Kokai No. 52-72698 (Hashimoto), part of a side wall of a heat shrinking synthetic resin tube is pulled through a slit in a paper, and therefore, the part protrudes on the other side of the paper. A support is inserted into this protruding part thereby providing a hanger portion. The article to be wrapped is inserted into the remaining portion of the tube that is not pulled through the slit, enabling the wrapped article to be held to the paper.

In French Published Application No. 2259765 (Daladoire) the bag comprises two sheets. The extension piece, which has a hole therein so it functions as the hanger, is a co-extension of the bag sheets per se and there is nothing disclosed about shrinkability.

In U.S. Pat. No. 2,983,087 (Schofield), the insert in the "hanger portion" of the bag representatively is cardboard and "is not intended for insertion in that part of the package under vacuum and therefore its shape is not likely to be distorted as happens to the package itself when it collapses around an object," lines 60–64 of colume 2 of Schofield. This limitation of Schofield results in a drawback in that only the commodity-containing portion of the bag, excluding the hanger portion, can be subjected to vacuum.

In U.S. Pat. No. 3,920,123 (Martelli), the edging material, i.e. the reinforcing member of the hanger portion, representatively is cardboard. It is required in this patent that the ends of the film edges are not adhered to this edging so that they may contract freely during shrinkage, lines 43–45 of column 1 of Martelli.

In U.S. Pat. No. 4,252,269 (Peppiatt), it is noted that the hanger portion (which is denoted in the patent as a handle) is welded to the bag along a weld as illustrated in FIG. 1 of this patent. The patent is specifically limited as to "said handle being welded along its inner boundary portion to only said gussett adjacent said fold line defining said inner boundary portion of said gussett", lines 8–12 of column 4 of the patent.

It is therefore an object of the invention to provide a hang bag comprising a bag of shrinkable film in which goods may be packaged and provided with improved hanger means. In particular it is an object of the invention to provide a bag wherein the hanger means are easily and conveniently incorporated into the bag and can have high strength, wherein the body of portion of the bag and the hanger portion of the bag have in common a face layer and a rear layer (1) that are laminated to a portion of the face panel and rear panel, respectively, of the body portion of the bag and (2) that have a reinforcing member of non-shrink film laminated between these two layers. In a preferred embodiment, a portion of the reinforcing member is disposed between (a) the adjacent portions of the face layer and face panel, or between (b) the adjacent portions of the rear layer and rear panel or between both (a) and (b). A further object of the invention is an improved way of making a hang bag having improved hanger means.

SUMMARY OF THE INVENTION

A hang bag according to the invention comprises a body portion in which goods may be packaged and that is a side weld bag formed of shrinkable film that is folded at a fold to define face and rear panels that are sealed along each side and that can be sealed across the end distant the fold, the improvement comprising: a hanger portion that extends at said fold away from the body portion and that comprises a face layer of heat shrinkable film that is laminated to and extends from and over a portion of said face panel and the external surface of said face panel has been corona treated, a rear layer of heat-shrinkable film that is laminated to and extends from and over a portion of said rear panel and the external surface of said rear panel has been corona treated, and a reinforcing member of non-shrink film that is laminated between the two said layers and that includes perforation means by which the bag may be hung from a peg and wherein the entire inwardly facing surfaces of said face and rear layers have been corona treated and both surfaces of the non-shrinkable film have been corona treated to improve the lamination of facing surfaces.

In a preferred aspect, the body portion is a double-side weld bag formed of shrinkable film that is folded at a fold, at said one fold end, to define said front and rear panels and these panels are sealed along each side. After insertion of the goods in the body portion, the panels are also sealed across the end distant from the fold. Said face and rear layers of shrinkable film securely extend from, respectively, said face and rear panels as a result of being laminated to these panels and extending from them.

In another preferred aspect of the invention, a portion of the reinforcing member of non-shrink film is disposed between (a) the adjacent portions of the face layers and face panel, or between (b) the adjacent portion of the rear layer and rear panel or between both (a) and (b). This allows for an even stronger hanger portion that cannot be easily removed by a tearing action.

In another preferred aspect of the invention, lamination of adjacent layers of film is by corona treatment lamination.

In another aspect of the invention, a hang bag is made by a method comprising providing a flattened double-side weld bag having face and rear panels of shrinkable film and formed by folding the shrinkable material about a fold, the improvement comprising corona treating the outer surfaces of the face and rear panels, providing a face layer of shrinkable film that is corona treated on its rear surface, providing a rear layer of shrinkable film that is corona treated on its face surface, providing a reinforcing, non-shrinkable film that is corona treated on both surfaces, providing an assembly of the shrinkable film layers substantially co-extensive with each other wherein at least one third of the length of the face and rear panels is covered by the face and rear layer and with the reinforcing film sandwiched between them at one end and with the side weld bag sandwiched between them at the other end with the fold of the side weld bag adjacent the reinforcing film; and laminating the facing corona treated surfaces of the assembly.

The invention also provides filled hand bags wherein goods are packaged in a hang bag as described above and the body portion is shrunk around the goods and sealed around its entire periphery.

DESCRIPTION OF THE DRAWING

The invention may be better understood by reference to the accompanying drawing which show one example of the invention and wherein.

DESCRIPTION OF THE PREFERRED EMBODIMENTS

Broadly, the body portion when flat will normally consist of substantially rectangular front and rear panels that are sealingly joined (either as a result of welding or as a result of folding a continuous sheet material) across one end and along two sides, with the intention that the remaining end can be heat sealed, so as to complete sealing of the entire periphery, after the goods that are to be packaged have been inserted into the bag.

Figure 2:
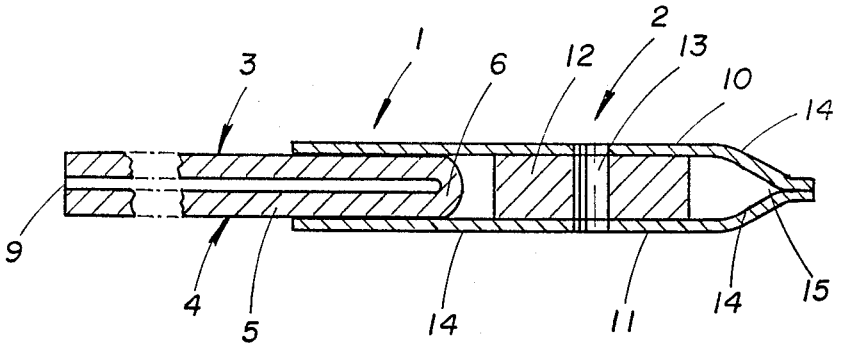
FIG. 2 is a cros-section on the line II—II in FIG. 1 (not to scale)
Figure 1:
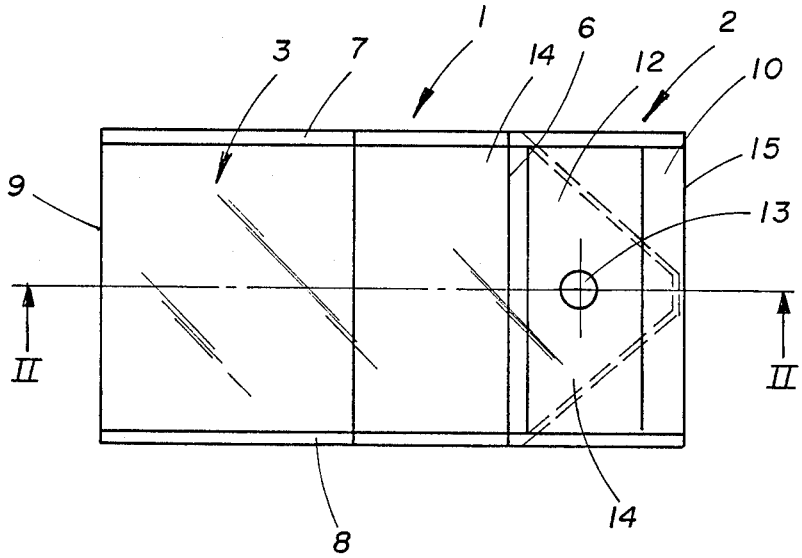
FIG. 1 is a plan view of a hang bag according to the invention.
Figure 3:
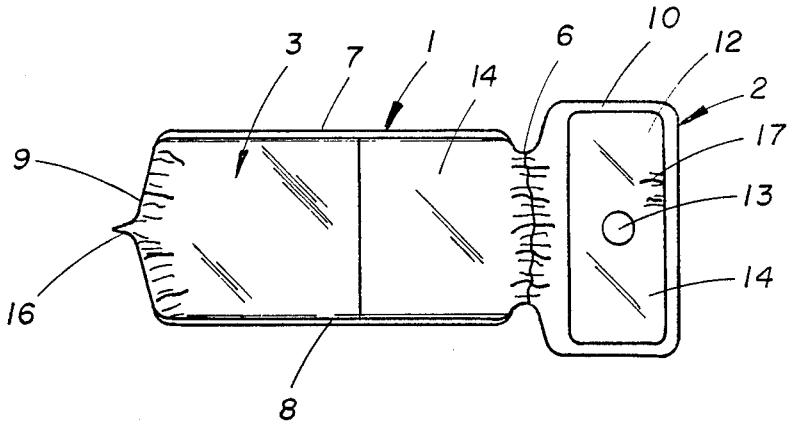
FIG. 3 is a plan view of the bag shown in FIG. 1 after filling, shrinking and heat sealing.

The hang bag shown in FIGS. 1,2, and 3 comprises a body portion 1 and a hanger portion 2. The body portion 1 is formed of face and rear panels 3 and 4. Each of the panels is formed of heat shrinkable film 5. These panels are sealingly joined across the width of the end 6 closest to the hanger portion.

It is particularly preferred as illustrated in FIG. 1 that the body portion should be double-side weld bag, in which event the bag is formed by folding the sheet material 5 upon itself to define the front and rear panels 3 and 4 and this fold serves as the join at the end 6. The assembly of the side weld bag is then completed by heat sealing the faces of the panels 3 and 4 to one another along the sides of the panels to form side welds 7 and 8. This heat sealing is generally effected before the goods are packaged in the bag, the bag being left, before use, open at the remaining end 9 to permit the insertion of the goods that are to be packaged in the body.

The hanger portion extends at the end 6 away from the body portion 1 and comprises a face layer 10 of shrinkable film extending away from the face panel 3, and a rear layer 11 of shrinkable film extending away from the rear panel 4.

The hanger portion also includes a reinforcing member of 12 non-shrinkable film that is secured between the layers 10 and 11. As is illustrated in FIGS. 1 and 2, reinforcing member 12 is disposed in the hanger portion in a manner such that it is adjacent said fold 6 yet remote from said fold 6 and therefore free from contact with said fold 6, said face panel 3, and said rear panel 4. This reinforcing member 12 is provided with a perforation 13 by which the bag may be hung from a peg. This perforation may be in the reinforcing member 12 before it is sandwich between the layers 10 and 11, in which event they must subsequently be perforated in the same place, but more usually the perforation is formed after laminating the layers 10, 12 and 11. It may be provided by any convenient piercing or punching means. It may be provided while the bag is flat or it may be provided after the bag has been filled with the goods that are to be packaged. For instance, the perforation may be formed by forcing the hanger portion of a filled bag onto a spike from which the bag is to be hung for display purposes.

It is necessary that the layers 10 and 11 should extend securely from, respectively, the face panel 3 and rear panel 4 in order that the hanger portion does not pull away from the body portion. When, as is preferred, the body portion comprises a double side weld bag the secure extension of the layers from the panels can be achieved by laminating film 14 of which the layers 10 and 11 are formed to the material 5 of which the panels 3 and 4 are formed over a substantial length of the body portion. Generally the film 14 is laminated to the film 5 over a length of at least one quarter, usually at least one third and sometimes at least one half of the length of the body portion from the end 6 towards the end 9.

In an alternative, and less preferred, construction other forms of body portions 1 may be utilized. For instance the body portion may be formed of a single side seal bag. Thus instead of having a side weld 7 that side of the bag may be provided by a fold in the sheet material and the end 6 and the opposite side 8 may be sealingly joined by heat welding, and 9 again being left open. In this less preferred construction, when the body portion is a single side seal bag, the secure extension of the face and rear layers can be provided by a continuation of the sheet material 5 beyond the end 6. For instance, a double layer of sheet material 5 may extend over the entire desired length of the hang bag, a transverse seal may be provided between the layers at 6 to provide the end of the body portion and the reinforcing member 12 may be sandwiched between the layers. Securement of the reinforcing member 12 between the layers is preferably promoted by corona treatment.

In the preferred construction, using a double side weld bag as illustrated in FIG. 1, lamination of the face and rear layers to, respectively, the face and rear panels is promoted by corona treatment. The reinforcing member is formed of non-shrinkable film and the securement of this between the face and rear layers is also preferably promoted by corona treatment.

Preferably, the face and rear panels 3 and 4 are subjected to corona treatment either over their entire area or over the part that is to be laminated with sheet material 14. This sheet material is corona treated over its entire inner surface. The reinforcing film 12 is corona treated over its two outer surfaces. All the facing corona treated surfaces are laminated to one another. As particularly illustrated in FIG. 2, sheet 14 is laminated to sheet material 5 over a substantial part of the length of the bag extending from the end 6; the sheet material 14 is laminated to the upper and lower surfaces of the reinforcing member 12; and the adjacent faces of the material 14 are laminated to one another at the end of the hanger portion 15.

The corona treatment may be conducted after laying the various components of the hang bag in position as shown in, for instance, FIG. 2 or the individual components may be subjected to corona treatment and then brought together and laminated. The corona treatment and lamination may be conducted in known manner using apparatus and methods as described in, for instance, U.S. Pat. Nos. 3,346,480, 3,823,061 or 4,120,716. Alternatively, a system as described in U.S. Pat. No. 3,900,538 may be utilized.

The provision of a double side weld bag as shown in the drawings may be conducted in conventional manner, for instance as described in U.S. Pat. No. 4,276,330. Alternatively a bag having a single side weld 8, a transverse weld 6 and a fold 7 may be provided in known manner.

The bag is generally manufactured and supplied flat, as shown in FIGS. 1 and 2 (but with or without the perforation 13) and the user then fills it with the goods to be packaged, for instance sausagement or other foodstuffs, and then causes shrinking of the bag to a tight fit around the foodstuffs and heat sealing of the end 9, as shown at 16, all in conventional manner. The extent to which the hanger portion will also shrink will depend upon the relative strengths of the reinforcing film 12 and the face and rear layers 10 and 11. Generally, the reinforcing film 12 is resistant to shrinking and distortion in which event it will, as shown in FIG. 3, undergo little or no reduction in dimensions. For instance, there may be some small folds as shown diagrammatically at 17 or the dimensions of the hanger portion may remain unchanged.

Figure 4:
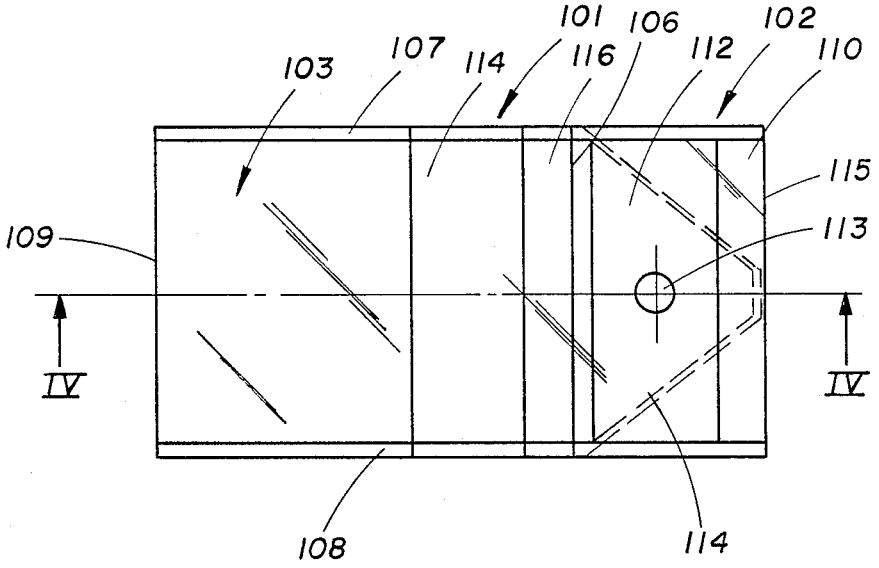
FIG. 4 is a plan view of a preferred hang bag of the invention wherein a portion of the reinforcing member is disposed between the adjacent portions of the rear layer and rear panels.
Figure 5:
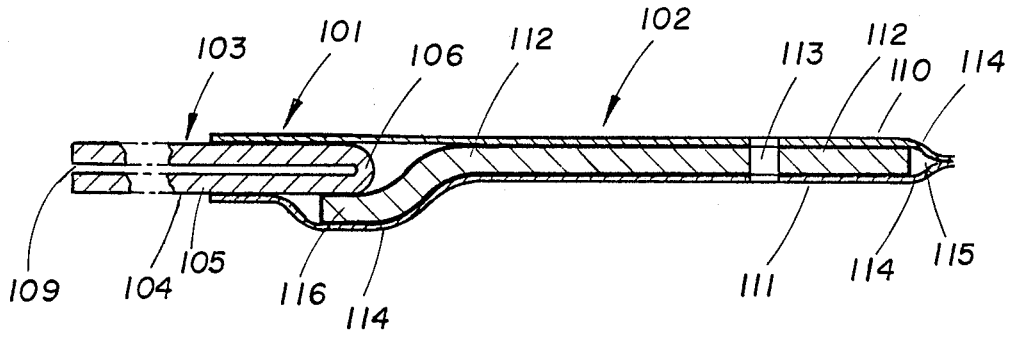
FIG. 5 is a cross-section on the line IV—IV of the bag in FIG. 4.

In a preferred embodiment the hang bag shown in FIGS. 4 and 5 comprises a body portion 101 and a hanger portion 102. The body portion 101 is formed of face and rear panels 103 and 104. Each of the panels is formed of heat shrinkable film 105. These panels are sealingly joined across the width of the end 106 closest to the hanger portion.

It is particularly preferred as illustrated in FIG. 4 that the body portion should be a double-side weld bag, in which event the bag is formed by folding the sheet material 105 upon itself to define the face and rear panels 103 and 104 and this fold serves as the join at the end 106. The assembly of the side weld bag is then completed by heat sealing the faces of the panels 103 and 104 to one another along the sides of the panels to form side welds 107 and 108. This heat sealing is generally effected before the goods are packaged in the bag, the bag being left, before use, open at the remaining end 109 to permit the insertion of the goods that are to be packaged in the body.

The hanger portion extends at the end 106 away from the body portion 101 and comprises a face layer 110 of shrinkable film extending away from the face panel 103, and a rear layer 111 of shrinkable film extending away from the rear panel 114.

The hanger portion also includes a reinforcing member 112 of non-shrinkable film that is secured between the layers 110 and 111. This reinforcing member 112 is provided with a perforation 113 by which the bag may be hung from a peg. This perforation may be in the reinforcing member 112 before it is sandwiched between the layers 110 and 111, in which event they must subsequently be perforated in the same place, but more usually the perforation is formed after laminating the layers 110, 112 and 111. It may be provided by any convenient piercing or punching means. It may be provided while the bag is flat or it may be provided after the bag has been filled with the goods that are to be packaged. For instance, the perforation may be formed by forcing the hanger portion of a filled bag onto a spike from which the bag is to be hung for display purposes.

It is necessary that the layers 110 and 111 should extend securely from, respectively, the face panel 103 and rear panel 104 in order that the hanger portion does not pull away from the body portion. When, as is preferred, the body portion comprises a double side weld bag the secure extension of the layers from the panels can be achieved by laminating film 114 of which the layers 110 and 111 are formed to the material 105 of which the panels 103 and 104 are formed over a substantial length of the body portion. Film 114 may be laminated to film 105 over the whole length of the bag on the front and/or the back. This is particularly advantageous when decoration is by trap printing. Generally, however, the film 114 is laminated to the film 105 over a length of at east one quarter, usually at least one third and sometimes at least one half of the length of thebody portion from the end 106 towards the end 109.

In an alternative, and less preferred, construction other forms of body portions 101 may be utilized. For instance, the body portion may be formed of a single side seal bag. Thus instead of having a side weld 107 that side of the bag may be provided by a fold in the sheet material and the end 106 and the opposite side 108 may be sealingly joined by heating welding, end 109 again being left open. In this less preferred construction, when the body portion is a single side seal bag, the secure extension of the face and rear layers can be provided by a continuation of the sheet material 105 beyond the end 106. For instance, a double layer of sheet material 105 may extend over the entire desired length of the hang bag, a transverse seal may be provided between the layers at 106 to provide the end of the body portion and the reinforcing member 112 may be sandwiched between the layers. Securement of the reinforcing member 112 between the layers is preferably promoted by corona treatment.

In the preferred construction, using a double side weld bag as illustrated in FIG. 4, lamination of the face and rear layers to, respectively, the face and rear panels is promoted by corona treatment. The reinforcing member 112 is formed of non-shrinkable film and the securement of this between the face and rear layers is also preferably promoted by corona treatment.

Figure 7:
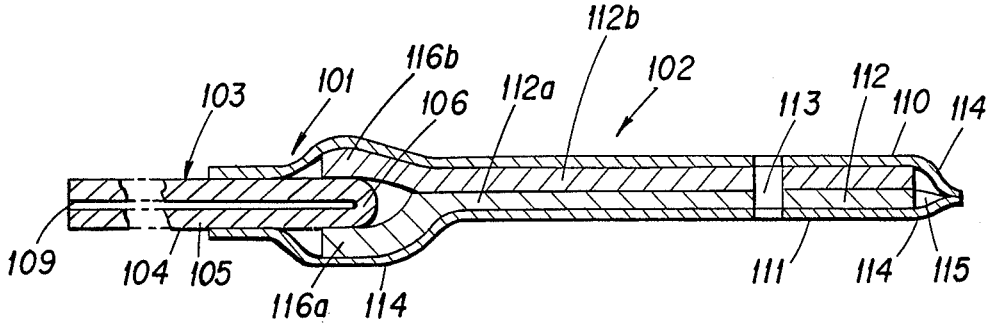
FIG. 7 is a variation of the cross-section of FIG. 5, wherein a two layer reinforcing member is disposed between adjacent portions of both a face layer and a panel and a rear layer and the panel.

Even more preferably, as illustrated in FIGS. 4 and 5, the reinforcing member 112 is monolayer and a portion 116 of the reinforcing member 112 is disposed between adjacent portions of the rear layer 111 and the rear panel 104. Portion 116 is disposed generally over a length of at least one quarter, usually at least one third and sometimes at least one half, of the length of the rear panel 104 from end 106 towards end 109. Also, a portion of the reinforcing member could be disposed between adjacent portions of the face layer 110 and the face panel 103. Alternatively, a portion **116*a* and a portion 116*b* of each layer 112*a* and 112*b* of a two layer reinforcing member could be disposed both between adjacent portions of the rear layer 111 and the rear panel 104 and between adjacent portions of the face layer 110 and the face panel 103 (illustrated in FIG. 7). In a preferred embodiment, portion 116 is disposed over a length at least 1 mm, usually at least 2 mm and sometimes at least 5 mm from end 106 towards end 109, which is advantageous when the bag is decorated by trap printing. This preferred disposition of the reinforcing member, whereby it is contiguous with fold line 106, affords a stronger hanger portion which cannot be easily removed by a tearing action, as compared to the embodiment illustrated in FIG. 1 and wherein the reinforcing member 12 is remote from fold line 6**.

Preferably, the face and rear panels 103 and 104 are subjected to corona treatment either over their entire area or over the part that is to be laminated with sheet material 114. This sheet material is corona treated over its entire inner surface. The reinforcing film 12 is corona treated over its two outer surfaces. All the facing corona treated surfaces are laminated to one another. As particularly illustrated in FIG. 5, sheet 114 is laminated to sheet material 105 over a substantial part of the length of the bag extending from the end 106, the sheet material 114 is laminated to the upper and lower surfaces of the reinforcing member 112 and the adjacent faces of the material 114 are laminated to one another at the end of the hanger portion 115.

Figure 6:
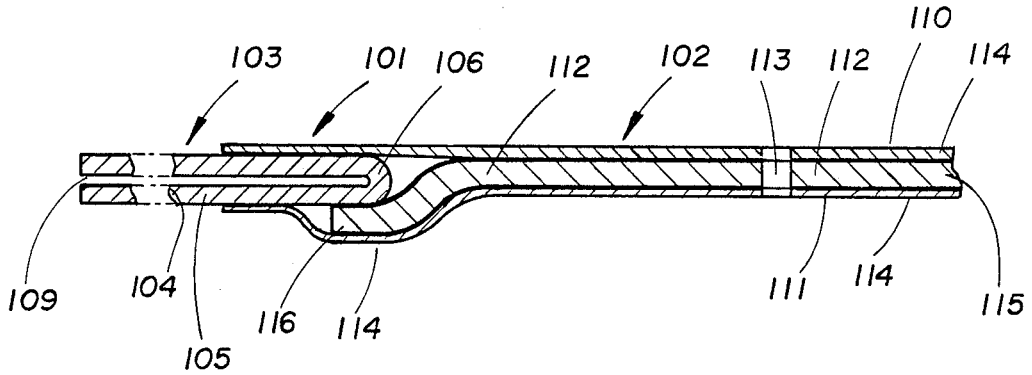
FIG. 6 is a variation of the cross-section of FIG. 5, wherein in the end of the hanger portion, the laminated face layer, reinforcing member, and rear layer end substantially coextensively.

In the alternative embodiment of the end portion 115 of the hanger portion 102, as illustrated in FIG. 6, the sheet material 114 is laminated substantially coextensively with the upper and lower surfaces of reinforcing member 112.

The shrinkable film of which the body portion 1 (FIGS. 1, 2, 3) or 101 (FIGS. 4, 5, 6) is made may be any thermoplastic heat shrinkable film having properties suitable for packaging of the goods that are to be enclosed in the body portion. Often it is a laminate. It may include a vapour impermeable barrier such as a vinylidene chloride copolymer (saran) and/or an ethylene vinly alcohol copolymer (EVOH) as one or more of its layers. Particularly suitable material is described in U.S. Pat. No. 3,741,253. Typically it is 0.005 to 0.05 mm thick, often 0.01 to 0.03 mm thick. The face and rear layers 10 and 11 (or 110 and 111) may be of the same thermoplastic heat-shrinkable material or, if they are laminat-ed onto the body portion as shown in FIGS. 2 and 5, they can if desired be of different heat-shrinkable material. Typically they will then be of a single ply material.

The reinforcing film 12 (or 112) is formed of non-shrink film, for instance of ethylene vinyl acetate, polyethylene or polypropylene, and typically it is 0.02 to 0.2 mm thick, often about 0.05 to 0.1 mm thick. Ethylene vinyl acetate is preferred, and more preferably is preferred ethylene vinyl acetate having a vinyl acetate content of about 3–4%.

Although the hanger portion is shown as being rectangular and of the same width as the body portion it can be of a lesser or greater width and, in particular, it can be shaped, for instance as shown by the dashed lines in FIGS. 1 and 4. The layers 10 and 11 and reinforcement 12 (or layers 110 and 111 and reinforcement 112) may be shaped before lamination or the hanger may be cut to shape after lamination.

As a result of the invention it is possible, for the first time, easily to provide a hang bag having a strong and very securely attached hanger and that is readily accessible and does not tend to cling to the body portion.

The hang bag may be provided with decoration or informative printing in conventional manner. Conveniently however such printing is on the shrinkable film extending beyond the body portion, i.e., on the layers 10 and/or 11 (or on the layers 110 and/or 111). This film may be surface printed or reverse printed, and thus printing may be trapped between the film 14 and either the film 5 or the film 12, (or between the film 114 and either the film 105 or the film 112).

What is claimed is:

1. In a hang bag that comprises a body portion in which goods may be packaged and that is a side weld bag formed of shrinkable film that is folded at a fold to define face and rear panels that are sealed along each side and that can be sealed across the end distant the fold, the improvement comprising: a hanger portion that extends at said fold away from the body portion and that comprises a face layer of heat-shrinkable film that is joined by corona lamination to and extends from and over a portion of said face panel and the external surface of said face panel has been corona treated, a rear layer of heat-shrinkable film that is joined by corona lamination to and extends from and over a portion of said rear panel and the external surface of said rear panel has been corona treated, and a reinforcing member of non-shrink film that is joined by corona lamination to the two said layers between them and that includes perforation means by which the bag may be hung from a peg and wherein the entire inwardly facing surfaces of said face and rear layers have been corona treated and both surfaces of the non-shrinkable film have been corona treated to improve the lamination of facing surfaces.

2. A bag according to claim 1 in which said face and rear layers are laminated respectively to said face and rear panels over at least one third of the length of the body portion.

3. A bag according to claim 1 in which the reinforcing member is disposed in the hanger portion in a manner such that it is adjacent said fold yet free from contact with said fold, said face panel and said rear panel.

4. A bag according to claim 1 in which the reinforcing member is monolayer and a portion of the monolayer reinforcing member is disposed between adjacent portions of the face layer and the face panel, whereby the reinforcing member is contiguous with said fold.

5. A bag according to claim 1 in which the reinforcing member is monolayer and a portion of the monolayer reinforcing member is disposed between adjacent portions of the rear layer and the rear panel, whereby the reinforcing member is contiguous with said fold.

6. In a filled hang bag that comprises a body portion in which goods are packaged and that is formed of face and rear panels that are formed of thermoplastic film folded about a fold thereby forming a fold end, said thermoplastic film having been shrunk onto the goods, and that are sealingly joined around their periphery, the improvement comprising: a hanger portion that extends at the said one fold end away from the body portion and that comprises a face layer of thermoplastic film that is joined by corona lamination to and extends over a portion of and securely from the face panel, a rear layer of thermoplastic film that is joined by corona lamination to and extends over a portion of and securely from the rear panel, and a reinforcing member of non-shrink film that is joined by corona lamination to the two said layers between them and that includes a perforation by which the bag may be hung from a peg.

7. A bag according to claim 6 in which said face and rear layers are laminated respectively to said face and rear panels over at least one third of the length of the body portion.

8. A bag according to claim 6 in which the reinforcing member is disposed in the hanger portion in a manner such that it is adjacent said fold yet free from contact with said fold, said face panel and said rear panel.

9. A bag according to claim 6 in which the reinforcing member is monolayer and a portion of the monolayer reinforcing member is disposed between adjacent portions of the face layer and the face panel, whereby the reinforcing member is contiguous with said fold.

10. A bag according to claim 6 in which the reinforcing member is monolayer and a portion of the monolayer reinforcing member is disposed between adjacent portions of the rear layer and the rear panel, whereby the reinforcing member is contiguous with said fold.

11. In a method of making a hang bag comprising providing a flattened double-side weld bag having face and rear panels of shrinkable film and formed by folding the shrinkable material about a fold, the improvement comprising: corona treating the outer surfaces of the face and rear panels, providing a face layer of shrinkable film that is corona treated on its rear surface, providing a rear layer of shrinkable film that is corona treated on its face surface, providing a reinforcing non-shrinkable film that is corona treated on both surfaces, providing an assembly of the shrinkable film layers substantially coextensive with each other wherein at least one third of the length of the face and rear panels is covered by the face and rear layer and with the reinforcing film sandwiched between them at one end and with the side weld bag sandwiched between them at the other end with said fold of the side weld bag adjacent the reinforcing film; and joining by corona lamination the facing corona treated surfaces of the assembly.

12. A bag according to claim 11 in which the reinforcing member is disposed in the hanger portion in a manner such that it is adjacent said fold yet free from contact with said fold, said face panel and said rear panel.

13. A method according to claim 11 in which the reinforcing member is monolayer and a portion of the monolayer reinforcing member is disposed between adjacent portions of the face layer and the face panel, whereby the reinforcing member is contiguous with said fold.

14. A method according to claim 11 in which the reinforcing member is monolayer and a portion of the monolayer reinforcing member is disposed between adjacent portions of the rear layer and the rear panel, whereby the reinforcing member is contiguous with said fold.

15. In a hang bag that comprises a body portion in which goods may be packaged and that is a side weld bag formed of shrinkable film that is folded at a fold to define face and rear panels that are sealed along each side and that can be sealed across the end distant the fold, the improvement comprising: a hanger portion that extends at said fold away from the body portion and that comprises a face layer of heat-shrinkable film that is laminated to and extends from and over a portion of said face panel and the external surface of said face panel has been corona treated, a rear layer of heat-shrinkable film that is laminated to and extends from and over a portion of said rear panel and the external surface of said rear panel has been corona treated, and a reinforcing member of non-shrink film that is laminated betweeh the two said layers and that includes perforation means by which the bag may be hung from a peg and wherein the entire inwardly facing surfaces of said face and rear layers have been corona treated and both surfaces of the non-shrinkable film have been corona treated to improve the lamination of facing surfaces, and the reinforcing member is two layers and a portion of one layer of the two layer reinforcing member is disposed between adjacent portions of the face layer and the face panel and a portion of the other layer of the two layer reinforcing member is disposed between adjacent portions of the rear layer and the rear panel, whereby the reinforcing member is contiguous with said fold.

16. In a filled hang bag that comprises a body portion in which goods are packaged and that is formed of face and rear panels that are formed of thermoplastic film folded about a fold thereby forming a fold end, said thermoplastic film having been shrunk onto the goods, and that are sealingly joined around their periphery, the improvement comprising: a hanger portion that extends at the said one fold end away from the body portion and that comprises a face layer of thermoplastic film that extends over a portion of and securely from the face panel, a rear layer of thermoplastic film that extends over a portion of and securely from the rear panel, and a reinforcing member of non-shrink film that is secured between the two said layers and that includes a perforation by which the bag may be hung from a peg, and the reinforcing member is two layers and a portion of one layer of the two layer reinforcing member is disposed between adjacent portion of the face layer and the face panel and a portion of the other layer of the two layer reinforcing member is disposed between adjacent portions of the rear layer and the rear panel, whereby the reinforcing member is contiguous with said fold.

17. In a method of making a hang bag comprising providing a flattened double-side weld bag having face and rear panels of shrinkable film and formed by folding the shrinkable material about a fold, the improvement comprising: corona treating the outer surfaces of the face and rear panels, providing a face layer of shrinkable film that is corona treated on its rear surface, providing a rear layer of shrinkable film that is corona treated on its face surface, providing a reinforcing non-shrinkable film that is corona treated on both surfaces, providing an assembly of the shrinkable film layers substantially coextensive with each other wherein at least one third of the length of the face and rear panels is covered by the face and rear layer and with the reinforcing film sandwiched between them at one end and with the side weld bag sandwiched between them at the other end with said fold of the side weld bag adjacent the reinforcing film; and laminating the facing corona treated surfaces of the assembly, and the reinforcing member is two layers and a portion of one layer of the two layer reinforcing member is disposed between adjacent portions of the face layer and the face panel and a portion of the other layer of the two layer reinforcing member is disposed between adjacent portions of the rear layer and the rear panel, whereby the reinforcing member is contiguous with said fold.

* * * * *